United States Patent [19]

Owen

[11] Patent Number: 4,732,320

[45] Date of Patent: Mar. 22, 1988

[54] RAILROAD GRADE CROSSING WITH TRANSVERSE SECURING SPLINES

[75] Inventor: S. Hudson Owen, Marshfield, Wis.

[73] Assignee: Koppers Company, Inc., Pittsburgh, Pa.

[21] Appl. No.: 863,416

[22] Filed: May 15, 1986

[51] Int. Cl.[4] ..... E01B 21/04

[52] U.S. Cl. ..... 238/8; 404/40

[58] Field of Search ..... 238/8; 404/40, 43, 46

[56] References Cited

U.S. PATENT DOCUMENTS

| | | | |
|---|---|---|---|
| 1,177,231 | 3/1916 | Carter | 404/40 |
| 1,230,058 | 6/1917 | Wooldridge | 238/8 |
| 1,279,062 | 9/1918 | Winter | 238/8 |
| 1,946,448 | 2/1934 | White et al. | 238/8 |
| 2,067,037 | 1/1937 | Alexander | 238/8 |
| 2,672,295 | 3/1954 | Cone | 238/8 |
| 3,863,840 | 2/1975 | Szarka et al. | 238/8 |
| 4,169,688 | 10/1979 | Toshio | 404/40 |

FOREIGN PATENT DOCUMENTS

| | | | |
|---|---|---|---|
| 0061429 | 9/1982 | European Pat. Off. | 238/8 |

*Primary Examiner*—David A. Scherbel
*Assistant Examiner*—Scott H. Werny
*Attorney, Agent, or Firm*—Daniel J. Long; Donald M. MacKay; Herbert J. Zeh, Jr.

[57] ABSTRACT

A railroad crossing is provided in which gage, transverse end, and outer field panels are joined by means of splines fitted into indentations on side surfaces of the panels whereby pairs of panels are joined together with a spline fitting partly into each side or end of adjoining panels; and lateral anchor members for fixing the panels adjacent to said rails, the end panels and the outer field panels whereby the need is obviated for affixing the panels to the ties by means of surface spikes.

11 Claims, 4 Drawing Figures

RAILROAD GRADE CROSSING WITH TRANSVERSE SECURING SPLINES

BACKGROUND OF THE INVENTION

In a conventional railroad grade crossing, wood deck panels are made to fill the space between the tops of the crossties and the top of the rails. The panels are installed over the ties outside the rails (called the field side) and between the rails (called the gage side). During installation, the wood deck panels are placed on the ties in predetermined locations, lead holes are drilled through the panels into the ties beneath, and drive spikes are driven through the panels into the ties, securing the panels in place. Usually eight drive spikes hold the deck panels in place on the ties against the forces generated by rail and vehicular traffic.

With the passage of time and traffic, the rail bed must be maintained at intervals of one to five years. Maintenance consists of replacing worn track parts, re-ballasting and re-aligning the track. At grade crossings, if the track is to be "maintained through" the crossing, the wood deck panels must be removed, and then replaced when the re-alignment is finished. Because the drive spikes are difficult to remove, the deck panels are often destroyed in the removal process.

Treated wood deck panels will last a long time in service, twenty years not being uncommon. Panels installed with drive spikes may develop adverse wear patterns over the years. Also the drive spikes may become raised above the deck surface causing a potential hazard to vehicle tires.

Since the life of the wood deck, if it is left in place, is substantially longer than the track maintenance cycle, many railroads will maintain the track up to each side of the crossing, but skip the crossing itself until the crossing deck is in such a condition that it must be replaced. Because crossings are short in length compared to the whole track, this minor deferred maintenance practice is tolerated in the interest of economy. However, as trains become heavier and faster, a higher degree of track maintenance is required, and the crossings must be repaired more often.

It is to provide an improved railroad crossing to which this invention is directed.

BRIEF DESCRIPTION OF THE INVENTION

It has been discovered that an improved railroad grade crossing can be built by joining the wood deck panels by means of steel splines fitted into slots (splineways) on the end and side surfaces of said panels, whereby pairs of panels are joined together with a spline fitting partly into each end of adjoining panels. The splines are held in place by steel fixtures fastened to the ties with conventional track spikes. Besides eliminating the potential vehicle tire hazard of drive spikes, the grade crossing of this invention has the advantage that it may be easily and rapidly removed during the track maintenance cycle, and then, it may be as easily and rapidly replaced, re-using the same deck panels and hardware. It is this ease and economy of removal and replacement that makes the grade crossing of this invention a substantial improvement over present grade crossings.

DETAILED DESCRIPTION OF THE INVENTION

Figure 1:
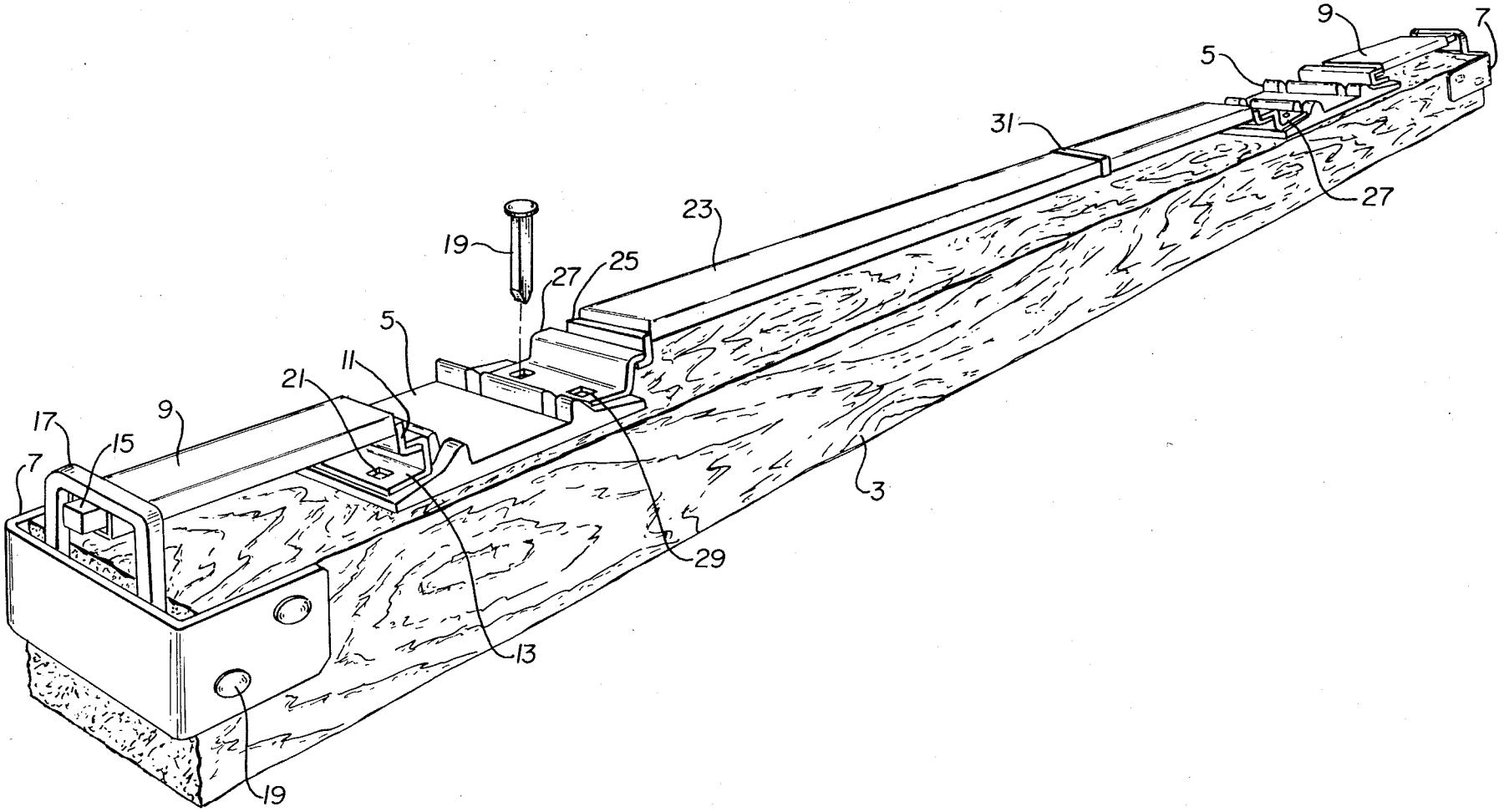
FIG. 1 is an isometric view of an individual crosstie located at the joint between the deck panels showing placement of the joint hardware pieces.

Referring now to the drawings, FIG. 1 shows the grade crossing panel connection hardware on crosstie 3 which is not visible from the finished surface when the deck is assembled. Standard eight hole tie plates 5 are used. A field spline retainer 7 is fastened to each end of the tie using track spikes 19, turning the tie on its side during installation of the field spline retainer, and then upright again for installation in the track. A field spline 9 with a hook 11 on one end engages a hook on a field clip 13; and with a tang 15 on the other end engages bail 17 of the field spline retainer. The field clip 13 is fastened to the tie 3 by driving track spikes 19 through holes 21 in the field clip and mating holes in the tie plate 5 into the crosstie 3.

A gage spline 23 with a hook 25 at each end engages the hook of gage clip 27 which gage clip is fastened in place by track spikes 19 driven through holes 29 in the gage clip and mating holes in the tie plate 5 into the crosstie 3. An electrical insulator 31 is installed between the ends of the gage spline 23 to prevent transmission of an electrical signal between rails at controlled crossings.

Figure 4:
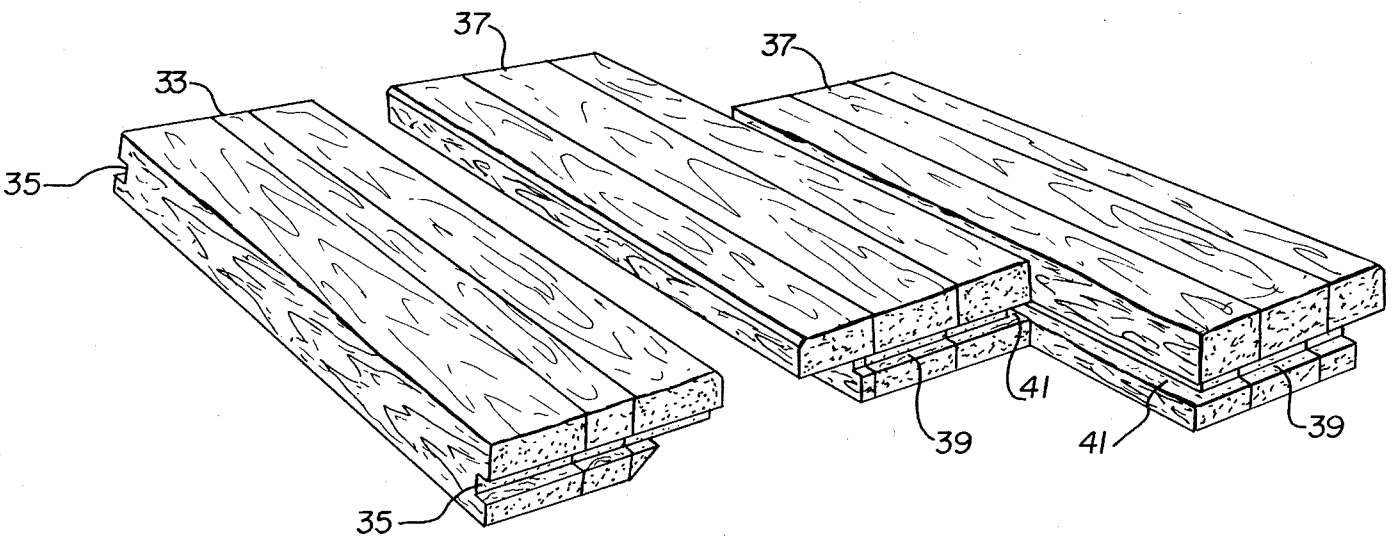
FIG. 4 is an isometric view of the field and gage deck panels showing the splineways milled in each end and longitudinal splineways milled along the length of the gage deck panels.

FIG. 4 illustrates the deck panel splineways. Field deck panel 33 has a splineway 35 milled in each end. Gage deck panel 37 has a splineway 39 milled in each end and has a longitudinal splineway 41 milled on the side of the panel.

The grade rail crossing of this invention is installed in two steps. In the first step, hardware fastened to the crosstie at the panel joints is installed. The field spline retainer 7 (FIG. 1) is fastened to the ends of the ties at the panel joints with track spikes 19. Field clips 13 and gage clips 27 are fastened to the tie with track spikes 19. The track is then ballasted, aligned and tamped in the usual manner if not previously done. Rail anchors 43 (FIG. 3) are installed on each side of each tie located at a panel joint (the ones with hardware on them) and at the deck ends.

Figure 2:
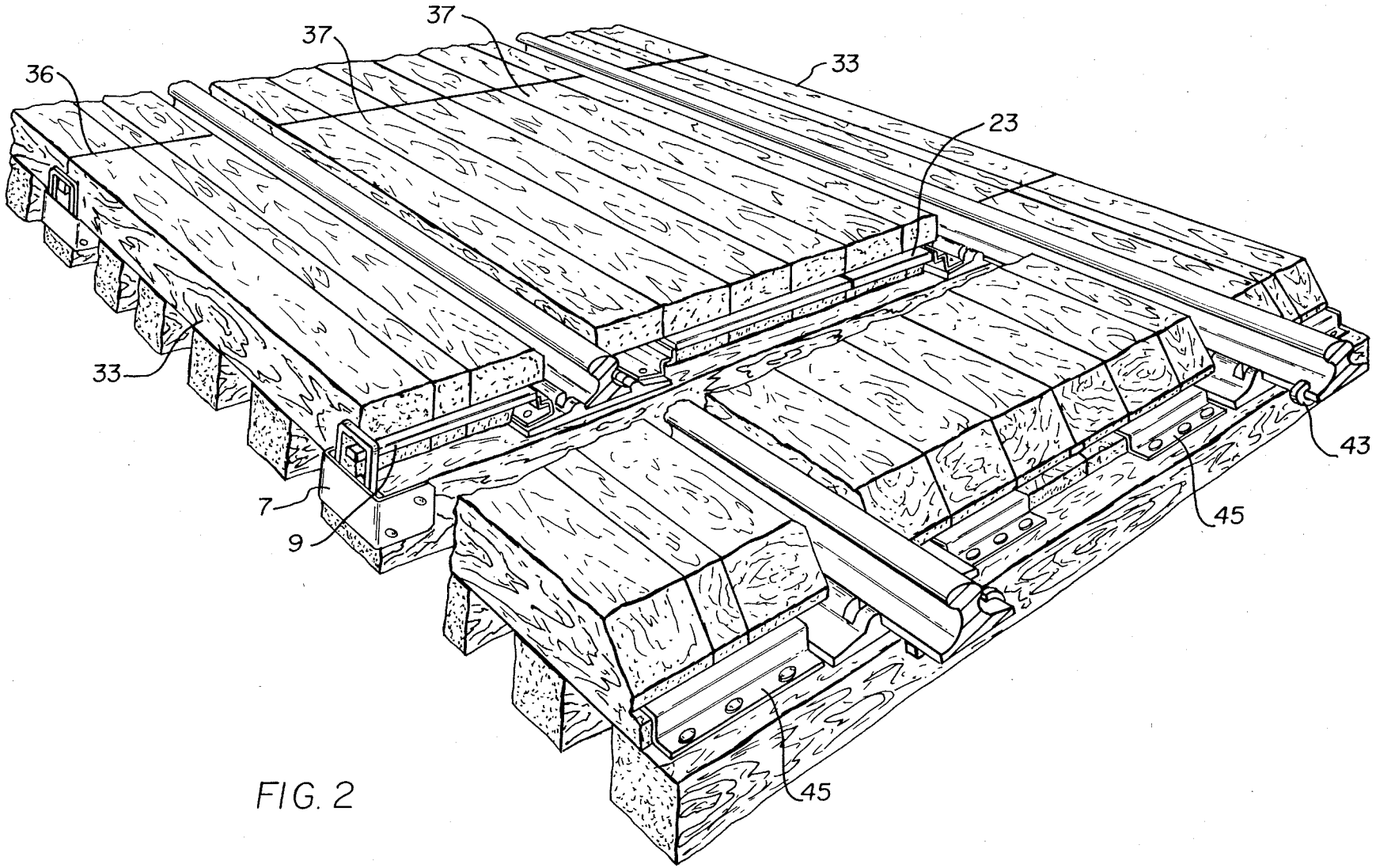
FIG. 2 is an isometric view of the end and center of a grade crossing assembly using straight transverse joints between panels.

Step two is placement and fastening of the deck panels. A field panel 33 (FIG. 2) is placed on the tie ends outside the rail with the panel ends at the center of the joint ties. A field spline 9 is inserted in splineway 35 (FIG. 4) on the end of the field panel 33 (FIG. 3) with the field spline tang 15 (FIG. 1) under the field spline retainer bail 17 and the field spline hook 11 under the hook on the field clip 13. Another field deck panel 33 (FIG. 2) is placed on the tie ends and pried horizontally over the previously installed field spline 9 at joint 36 making a connection between the panels. Another field spline 9 is installed in the free end of the field panel splineway 35 (FIG. 4) and the above procedure repeated until all of the field deck panels are in place. End Z anchors 45 are fastened to the end ties with track spikes 19 securing the field deck panels in place.

Figure 3:
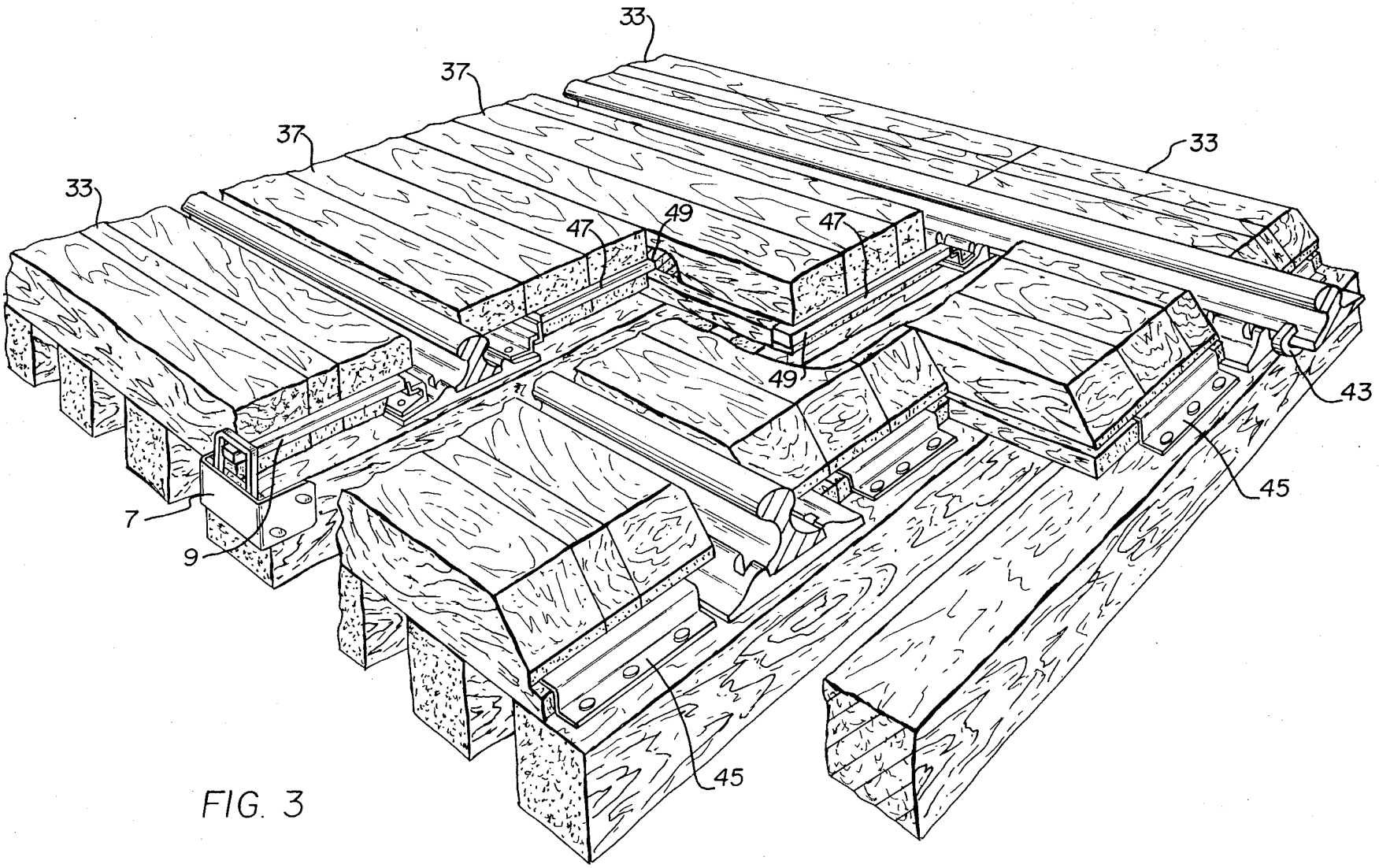
FIG. 3 is an isometric view of the end and center of a grade crossing assembly using staggered transverse joints between panels.

Gage deck panels may be installed with straight joints (FIG. 2) or staggered joints (FIG. 3). In straight joint installation, the gage deck panels 37 are placed on ties between the rails with the panel ends aligned on the joint ties. A gage spline 23 (FIG. 1) is installed in the panels splineway 39 (FIG. 4) with the hook on each end 25 (FIG. 1) underneath the hook on the gage clips 27. Two more gage deck panels 37 (FIG. 2) are then placed on the ties between the rails and pried horizontally over the previously installed gage spline 23 until it is fully engaged in the panels splineway 39 (FIG. 4). Another gage spline 23 (FIG. 2) is installed in the splineway 39 (FIG. 4) at the other end of the gage deck panels as above and the procedure repeated until all of the gage deck panels 37 are in place. End Z anchors 45 (FIG. 2) are fastened to the end ties with track spikes 19 securing the gage deck panels 37 in place.

In staggered joint installation (FIG. 3), gage deck panels 37 are placed on the ties between the rails, but with their ends staggered to align with the previously installed gage clips 27 (FIG. 1). A gage half spline 47 (FIG. 3) with a hook 25 on only one end, is installed in the splineway 39 (FIG. 4) of the near gage deck panel 37 (FIG. 3). The hook 25 (FIG. 1) goes under the hook on the near gage clip 27 (FIG. 1) and the free end of the gage half spline 49 (FIG. 3), which projects beyond the centerline of the track, is engaged in the longitudinal splineway 41 (FIG. 4) of the far gage deck panel 37.

Another gage deck panel 37 is placed on the near side between the rails and pried horizontally until the splineway 39 (FIG. 4) is engaged with the previously installed gage half spline 47 (FIG. 3). Then a second gage half spline 47 is installed in the splineway 39 of the far gage deck panel 37 with the hook 25 (FIG. 1) under the hook of the far gage clip 27 (FIG. 1) and the free end of the gage half spline 49 (FIG. 3) engaged in the longitudinal splineway 41 (FIG. 4) of the near gage deck panel 37.

Another gage deck panel 37 is placed on the far side of the ties between the rails and pried horizontally over the installed far gage half spline 47. Another gage half spline 47 is installed in the splineway 39 (FIG. 4) of the near gage deck panel 37. This alternating procedure is repeated until all of the gage deck panels 37 are in place. End Z anchors 45 are fastened to the end ties with track spikes 19 securing the gage deck panels in place.

In order to remove the deck panels for maintenance or replacement, the end Z anchors 45 are removed by pulling the track spikes 19. Deck panels 33 and 37 are then pried horizontally off splines 9 and 23 and lifted to the side of the track to be reused. The exposed splines 9 and 23 are removed by prying them out of the splineways 35 and 39 and from under the hooks of the field clips 13 and gage clips 27. The next panels are removed as above and the process repeated until all of the deck panels and hardware are at the side of the track.

The field spline retainers 7, field clips 13, and gage clips 27, remain in place for further use.

Following track maintenance, the crossing deck is re-installed using the above procedure in reverse. By reusing the hardware and the deck panels, considerable time and expense are saved.

While the above description is illustrative of the Best Mode and preferred embodiments of the invention, numerous variations may occur to one of ordinary skill and accordingly, this invention is intended to be limited only by the appended claims.

What is claimed is:

1. A railroad crossing comprising rails supported by ties on a ballast and a deck of gage, transverse end and outer field panels supported by said ties adjacent to said rails, said panels being substantially level with the top of said rails so as to allow motor vehicle traffic to cross over said rails, the improvement which comprises joining panels by means of transverse splines fitted into indentations on end surfaces of said gage, transverse end and outer field panels whereby pairs of panels are joined together with one of said splines fitting partly into each end of adjoining panels; and lateral anchor means for engaging the transverse splines and thereby fixing the gage panels adjacent to said rails, transverse end panels and outer field panels whereby the need is obviated for affixing the panels to the ties by means of surface spikes.

2. The crossing of claim 1 wherein the longitudinal axis of the panels is parallel to the rails.

3. The crossing of claim 1 wherein at least some of the panels are anchored by means of a Z clamp whereby a bottom leg of the Z clamp is affixed to a tie and a upper leg is positioned against the side of a panel.

4. The crossing of claim 1 wherein the longitudinal axis of the panels is parallel to the rails, and end panels and interior panels are anchored by means of a Z clamp whereby a bottom leg of the Z clamp is affixed to a tie and a upper leg is positioned against the side of a panel.

5. The crossing of claim 1 wherein the outer field panels are anchored by means of a field spline retainer having a vertical bail resting against the panel and a U shaped base wrapped around a tie whereby each leg of the U shaped base is affixed to the side of said tie and a spline is contained within said retainer.

6. The crossing of claim 1 wherein panels adjacent to a rail have indentations on the sides adjacent to the rail for receiving anchor means.

7. The crossing of claim 1 wherein end panels have lateral indentations for receiving anchor means.

8. The crossing of claim 1 wherein field panels are joined together with a spline having a hook mated at the rail side to a hook affixed to a tie plate and said panels affixed at the tie end with a field spline retainer having a vertical bail resting against the panel and a U shaped base wrapped around the tie sides and the end of the tie whereby each leg of the U shaped base is affixed to the side of a tie, the end of said spline contained within said bail.

9. The crossing of claim 1 wherein gage panels are joined together each with a spline having terminal hooks, said hooks mated with hooks affixed to tie plates.

10. The crossing of claim 1 wherein the gage panels along the rail centerline have lateral splineways and are joined by means of a spline.

11. The crossing of claim 1 wherein gage panels are staggered.

* * * * *